United States Patent [19]

Zuckerman

[11] Patent Number: 4,698,989

[45] Date of Patent: Oct. 13, 1987

[54] DOUBLE CYLINDER LOCK ASSEMBLY

[75] Inventor: Martin Zuckerman, Villa Park, Calif.

[73] Assignee: Kwikset Corporation, Anaheim, Calif.

[21] Appl. No.: 912,905

[22] Filed: Sep. 26, 1986

[51] Int. Cl.[4] ..... E05B 17/04

[52] U.S. Cl. ..... 70/380; 70/DIG. 42; 70/DIG. 60

[58] Field of Search ..... 70/222, 223, 379 R, 70/380, 389, DIG. 35, DIG. 42, DIG. 60

[56] References Cited

U.S. PATENT DOCUMENTS

| | | | |
|---|---|---|---|
| 4,068,510 | 1/1978 | Neary | 70/379 R |
| 4,100,774 | 7/1978 | Solovieff | 70/380 |
| 4,109,496 | 8/1978 | Allemann | 70/380 |
| 4,228,669 | 10/1980 | Bischoff | 70/379 R |
| 4,254,648 | 3/1981 | Dietrich | 70/380 |
| 4,369,642 | 1/1983 | Grell | 70/389 |

*Primary Examiner*—Robert L. Wolfe
*Attorney, Agent, or Firm*—Barry E. Deutsch

[57] ABSTRACT

A double cylinder lock assembly includes a drive mechanism for extending and retracting a bolt, and exterior and interior key cylinder on opposite sides of said drive mechanism. The assembly further includes a torque blade extending from one of the key cylinders through the drive mechanism in operable engagement therewith toward the other key cylinder. An engagable clutch is disposed between the torque blade and the interior key cylinder. The clutch includes a pair of disengagable drive members, one of which is engagable by the torque blade and rotatable therewith and the second of which is rotatable with the interior key cylinder. The second engageable drive member includes a drive lug extending radially inward towards the horizontal axis of the interior key cylinder. The first drive member has a radially extending slot and is normally biased in an axially spaced position with respect to the second drive member and is axially movable theretowards in response to a key inserted into said interior cylinder to place the drive lug into driving engagement with the radially extending slot.

13 Claims, 4 Drawing Figures

FIG. 2
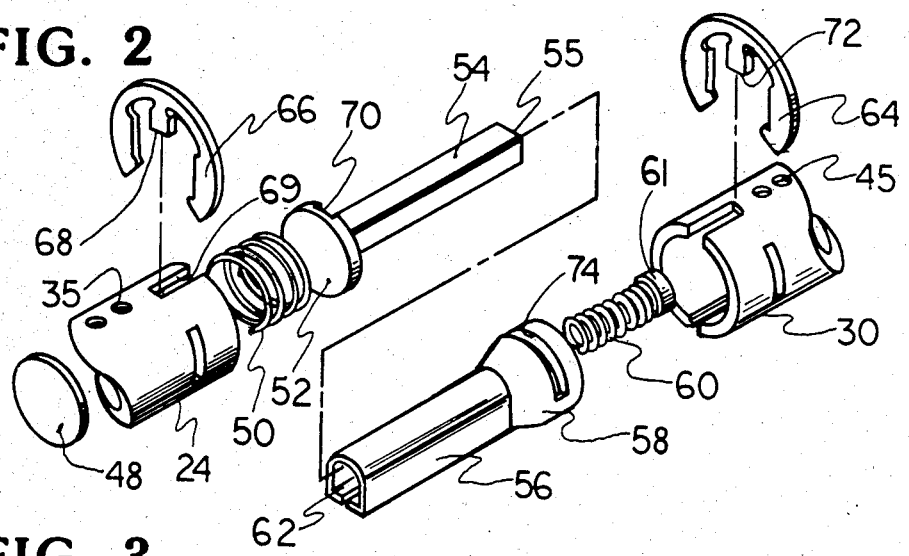
FIG. 3
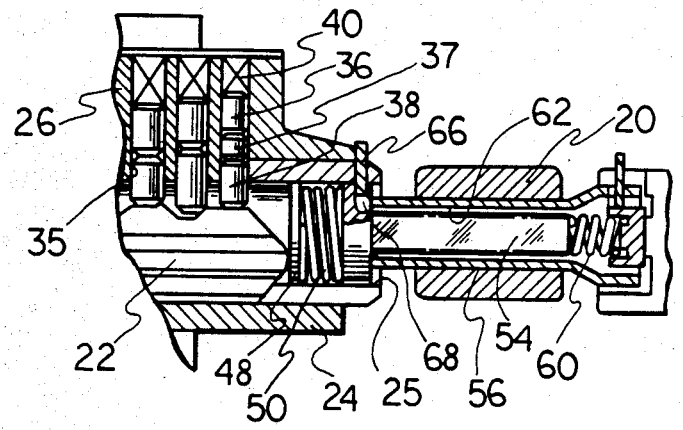
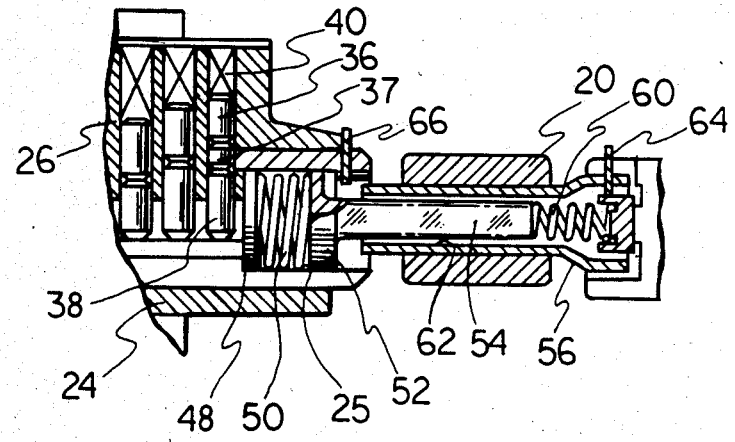
FIG. 4

DOUBLE CYLINDER LOCK ASSEMBLY

BACKGROUND OF THE INVENTION

This invention relates to a double cylinder lock assembly operable by a key from the interior or exterior, and in particular, to an assembly where a key is retained in the interior cylinder when the lock bolt is extended or placed in a locked position from the interior of the door, or when the key is already positioned within the interior cylinder keyway and the lock bolt is extended by operation of the exterior cylinder.

Deadbolt locksets in current use have been resorted to for the purpose of adding to security against break-ins by unauthorized persons. Such locksets comprise a deadbolt mechanism manipulated on the outside by a key actuated mechanism and on the inside, in the alternative, by either a thumb turn or a keyed cylinder inner trim. A single lock cylinder requires a key to actuate it from the exterior but utilizes a thumb turn at the interior. A double lock cylinder requires a key to actuate it from the interior as well as the exterior. There are environments in which the single lock cylinder is preferable, and other environments where the double lock cylinder is preferable. Usually this is determined by the needs of the owner of the premises and/or building code requirements.

The double lock cylinder or keyed cylinder inner trim, is devoid of a thumb turn and depends upon a key to be opened. The double cylinder lock effectively prevents an intruder from opening a door provided with such lock from the inside even after entry has been made by some other means. Hence, bulky or large articles are more difficult to remove from the premises. Where double cylinder locks are employed, it is desirable and sometimes required that the key not be extractable from the interior cylinder when the lock bolt is extended to locked position by an occupant who remains inside. This is to assure ready unlocking capacity for rapid exit under panic conditions, such as fire.

Heretofore, rather complex and relatively costly mechanisms have been utilized to prevent extraction of the key from the interior cylinder when the lock bolt is extended by an occupant remaining on the inside of a door. Such complex mechanisms increase the cost of manufacturing double cylinder locksets and, due to their complexity, do not always function in a totally reliable manner. Accordingly, it is an object of this invention to provide a double cylinder lock of generally conventional construction, with only a modest modification being needed to retain the key in the lock when the locking bolt is extended to locked position by an occupant remaining inside, and wherein such modification is both relatively inexpensive and reliable.

SUMMARY OF THE INVENTION

The foregoing object and other objects of the present invention are attained in a double cylinder lock assembly having means for extending and retracting a bolt, and interior and exterior key cylinders on opposite sides of said means, comprising a torque blade extending from one of said key cylinders through said means in operable engagement therewith toward said other key cylinder; an engageable clutch between said torque blade and said other key cylinder, said clutch including means mounted on the cylinder plug of said key cylinder for maintaining the cylinder plug in an axially spaced positioned with respect to the cylinder housing of said other key cylinder and for coupling said cylinder plug to said torque blade for rotation therewith and; means responsive to insertion of a key into said plug for moving said torque blade into coupling relation with said cylinder plug mounted means.

BRIEF DESCRIPTION OF THE DRAWING

FIG. 2 is a fragmentary exploded perspective view of the internal mechanism of the double cylinder lock;

FIG. 3 is an enlarged fragmentary elevational sectional view of the internal lock assembly showing the clutch mechanism in an engaged position; and FIG. 4 a view similar to FIG. 3 showing the clutch mechanism in a disengaged position.

DESCRIPTION OF THE PREFERRED EMBODIMENT

Figure 1:
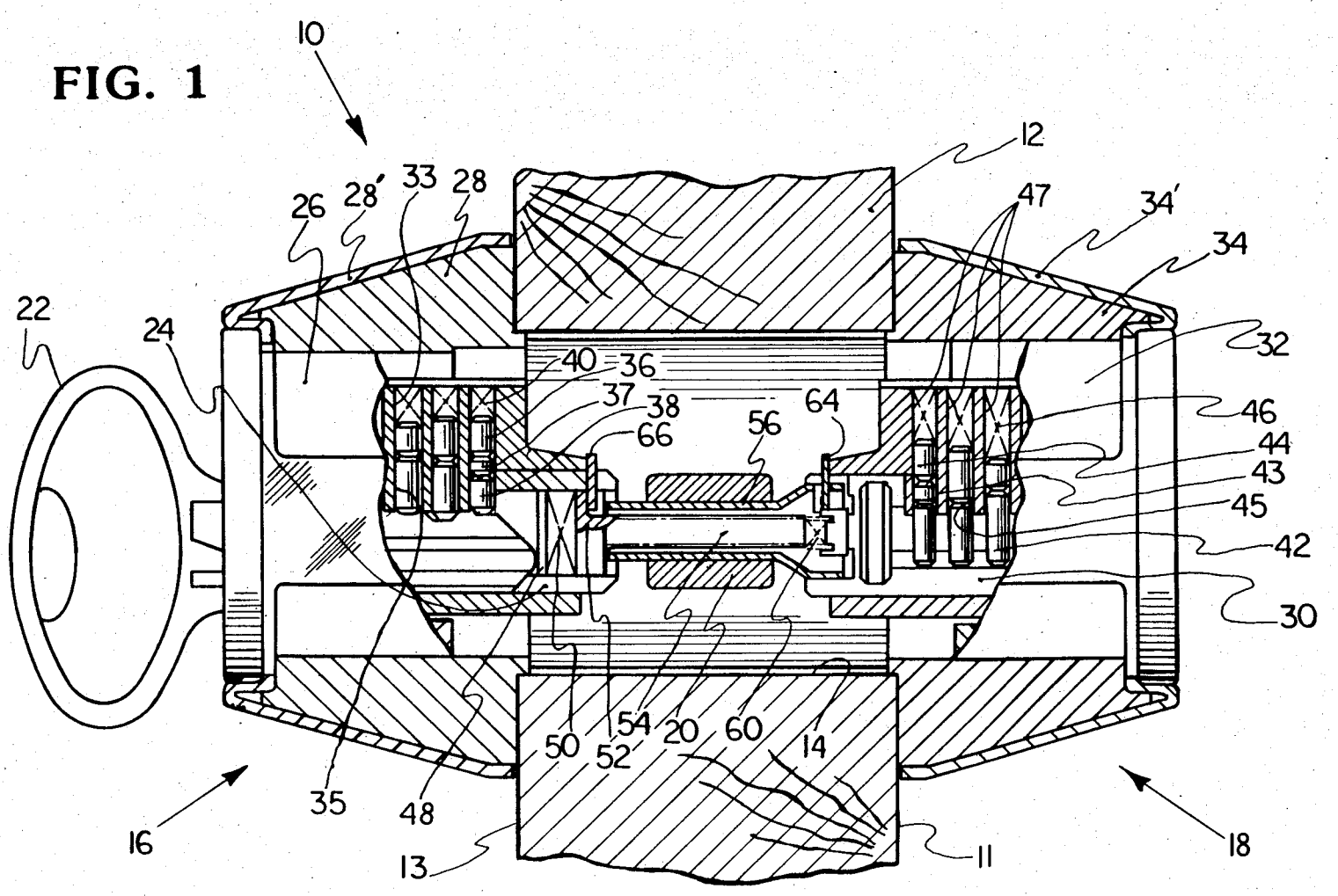
FIG. 1 is a sectional elevational view of a double cylinder lock mechanism employing the present invention mounted on a door.

Referring now to the various figures of the drawing, there shall be described a preferred embodiment of the present invention. In referring to the various figures, like numerals shall refer to like parts.

Referring specifically to FIG. 1 of the drawing, deadbolt lockset 10 embodying the present invention, is illustrated as mounted in door 12. Door 12 has an outer face 11 and an inner face 13 and further includes an axially extending bore 14 for receiving deadbolt lockset 10. The deadbolt lockset includes an outside trim assembly 18 and an inside trim assembly 16 mounted respectively on the outer and inner faces of door 12.

Outer trim assembly 18 is a substantially conventional key actuated mechanism by means of which an outer tailpiece or torque blade 56 (see FIG. 2) is rotated for the purpose of extending and withdrawing a locking bolt (not shown). As illustrated in FIG. 2, outer tailpiece 56 is substantially "D" shaped in cross-section and extends into a comparable portion of an opening in a rotatably mounted hub 20 (see FIG. 3). Hub 20 is adapted to manipulate an appropriate conventional roll back mechanism by means of which rotational motion is converted to linear motion to extend and retract the locking bolt. As the details of the locking bolt and operating mechanism therefor are conventional, such details have not been shown. Such details are, as an example, illustrated in U.S. Pat. No. 4,100,774 issued July 18, 1978.

Outer trim assembly 18 includes cylinder plug 30 rotatably mounted within cylinder housing 32. The trim assembly further includes cylinder guard 34 and cover 34' (and a shield not illustrated). As illustrated in FIG. 2, plug 30 has a series of bores 45 extending radially therethrough. Similarly, housing 32 includes a series of radially extending bores 47. Top pins 44 are disposed within bores 47 and bottom pins 42 are disposed within bores 45. Top springs 46 are provided to drive pins 44 and 42. A master pin 43 is also provided in a selected one of the bores for conventional reasons. The operation of the pins within their respective bores are conventional in form. Spring clip 64 joins torque blade 56 to plug 30 for rotation therewith. Clip 64 includes a radially extending finger 72 which fits within circumferentially extending slot 74. The foregoing provides a lost motion arrangement between plug 30 and torque blade 56.

Inner trim assembly 16 will now be described in detail as the present invention is embodied within the inner trim assembly. Assembly 16 includes a rotatable plug 24 mounted within housing 26. A cylinder guard 28 and cover 28' is provided to secure the plug and housing to the inner face 13 of door 12.

Housing 26 includes axially aligned radially extending bores 33. Likewise, plug 24 includes axially aligned radially extending bores 35. The plug and housing include top pin springs 40, top pins 36, and bottom pins 38. A master pin 37 is provided in one of the bores for a reason well known to those skilled in the art. As well known to those skilled in the art, when a key, such as key 22, is inserted into plug 24 and bores 33 and 35 are radially aligned, the plug can be rotated relative to stationary cylinder housing 26.

Plug 24 includes an axially extending bore 25, illustrated particularly in FIGS. 3 and 4. Disc or washer 48 lies at the closed end of the bore. The open end of the bore is closed by the enlarged head 52 of tailpiece driver or torque blade 54. Torque blade 54 extends axially into the hollow portion 62 of blade 56. A compression spring 50 is sandwiched between washer 48 and enlarged head 52. End 55 of shaft 54 engages a spring 60 extending axially from plug 30 towards blade 54. Spring 60 provides a force to push blade 54 towards the left as viewed in FIGS. 3 and 4 for a reason to be more fully explained hereinafter. The force generated by compression of spring 50 is greater than the force generated by spring 60. It should be noted that enlarged head 52 includes a radially extending slot 70.

A spring clip 66 is employed to maintain plug 24 axially positioned within cylinder housing 26. Clip 66 includes a radially extending finger or drive lug 68 aligned with axially extending slot 69 formed within plug 24.

The foregoing describes the essential details of a double cylinder lock assembly including the present invention. As noted previously, a double cylinder lock may be actuated from either side of a door, with the locking of either cylinder moving the locking bolt to an extended or locked position. When the inside cylinder is used to extend the locking bolt to a locked position, it is essential that the key used to extend the locking bolt is maintained within the cylinder plug to enable someone on the inside of the door to immediately open same under panic conditions. The present invention provides a clutch arrangement which enables an occupant situated on the inside of the door to employ a key to place the locking bolt in an extended or locked position and, while in such position, prevents the key from being removed from the cylinder of the lockset.

In operation, let us assume an occupant desires to place the locking bolt in an extended or deadbolt position. The occupant inserts key 22 which, as illustrated in FIG. 3, when fully inserted within plug 24 bears against washer 48. The key provides a force to compress spring 50 which, in turn, moves enlarged head 52 and its attached torque blade 54 to the right as viewed in FIGS. 3 and 4. Assuming that slot 70 in head 52 is in radial alignment with drive lug 68 of clip 66, such movement will result in the engagement of the drive lug within the slot. Thus, when key 22 is turned to rotate the cylinder plug to a locked position, clip 66 will rotate with plug 24 and, due to engagement of drive lug 68 within slot 70 will likewise result in rotation of the torque blade 54. By rotating torque blade 54, torque blade 56 will likewise be rotated thereby rotating hub 20 to place the locking bolt in its deadbolt position.

When the cylinder plug is rotated to its locked position, bores 35 are no longer radially aligned with bores 33. Thus, pins 38 in cooperation with the inner surface of plug 24 lock the key within the plug's keyway to prevent its removal. The key may only be removed when the plug is rotated so that bores 33 and 35 are radially aligned.

When the key is removed, the compressive force on spring 50 is eliminated thereby enabling the spring to return to the relaxed position illustrated in FIG. 4. The return force generated by relaxation of spring 50, in addition to the return force generated by spring 60 results in torque blade 54 moving to the left as viewed in FIG. 4 whereby slot 70 is axially spaced from lug 68. In the absence of a driving connection between the torque blade 54 and plug 24, any rotation of outside cylinder 30 will have no effect on plug 24. Thus, turning outside plug 30 to a locked position results in rotation of torque blade 56 and hub 20 to effect movement of the locking bolt to its extended position. Although, torque blade 54 will rotate with rotation of torque blade 56, plug 24 will remain stationary. Thus, it is possible that slot 70 may be radially misaligned with respect to lug 68.

Upon reinsertion of key 22 within the keyway when lug 68 and slot 70 are radially misaligned, rotation of the key will result in rotation of plug 24; however, due to the lack of any driving connection between plug 24 and torque blade 54, the torque blade will remain stationary. This condition will exist until the plug is rotated so that the lug and slot are radially aligned whereby the force generated by compressed spring 50 will drive the lug and slot into engagement when they are radially aligned. With the key remaining locked in the keyway, any subsequent rotation of the cylinder results in concomitant rotation of the torque blade. The clutch arrangement established by lug 68 and slot 70 ensures that any rotation of cylinder 24 will result in simultaneous movement of the locking bolt when the key is inserted within the keyway and the lug and slot are axially aligned. Unlike outside operator 18 which includes a lost motion arrangement (via slot 74 and finger 72) the positive inside operator clutch arrangement defined by slot 70 and drive lug 68 ensures that the key will be retained in the cylinder when the locking bolt is extended to locked position by an occupant remaining inside since it is impossible to return the key to a position from whence it can be removed from the keyway without simultaneously retracting the locking bolt.

The clutch arrangement for positively ensuring that the key will be retained within the keyway when the locking bolt is extended is relatively inexpensive to implement and due to the absence of any complex mechanism should be reliable in operation over an extended operating life.

While a preferred embodiment of the present invention has been described and illustrated, the invention should not be limited thereto but may be otherwise embodied within the scope of the following claims.

I claim:

1. A double cylinder lock assembly having means for extending and retracting a bolt, and exterior and interior key cylinders on opposite sides of said means, comprising:

a rotatable torque blade driver extending from one of said key cylinders through said means in operative engagement therewith toward said other key cylinder;

an engagable clutch between said torque blade and said other key cylinder; and said clutch including a pair of disengagable drive members, one of which is engaged by said torque blade and rotatable therewith; and the second of which is rotatable with said interior key cylinder and includes a drive lug extending radially inward towards the horizontal axis of said interior key cylinder, said one drive member having a radially extending slot and being normally biased in an axially spaced position with respect to said second drive member and being axially movable towards said member in response to a key inserted into the interior cylinder to place said drive lug into driving engagement with said radially extending slot.

2. A double cylinder lock in accordance with claim 1 wherein said one drive member is a second torque blade and includes an axially extending generally cylindrical portion and an enlarged head portion attached to the end of said cylindrical portion adjacent said interior cylinder, said radially extending slot being formed in said enlarged head portion.

3. A double cylinder lock in accordance with claim 2 wherein said second drive member is generally ring-shaped.

4. A double cylinder lock in accordance with claim 3 further including a spring for biasing said one drive member into said axially spaced position with respect to said second drive member, said spring being retained between an interior end of said interior cylinder and an exterior end of said enlarged head portion.

5. A double cylinder lock in accordance with claim 4 wherein said spring is compressed by said key in said interior cylinder.

6. A double cylinder lock in accordance with claim 2 further including a spring for biasing said one drive member into said axially spaced position with respect to said second drive member, said spring being retained between an interior end of said interior cylinder and an exterior end of said enlarged head portion.

7. A double cylinder lock assembly having means for extending and retracting a bolt; and exterior and interior key cylinders on opposite sides of said means, comprising;

a rotatable torque blade extending from one of said key cylinders through said means in operative engagement therewith toward said other key cylinder;

an engagable clutch between said torque blade and said other key cylinder, said clutch including means mounted on the cylinder plug of said other key cylinder for maintaining the plug axially positioned with respect to the housing of said other key cylinder and for coupling said cylinder plug to said torque blade for rotation therewith; and means responsive to insertion of a key into said cylinder plug for moving said torque blade into coupling relation with said cylinder plug mounted means.

8. A double cylinder lock assembly in accordance with claim 7 wherein said cylinder plug mounted means is generally ring-shaped and includes a drive lug extending radially inward towards the horizontal axis of said other key cylinder.

9. A double cylinder lock in accordance with claim 8 wherein said torque blade includes an enlarged head portion having a radially extending slot engaged with the drive lug of said retaining ring when the torque blade is moved into coupling relation with said cylinder plug mounted means.

10. A double cylinder lock assembly having means for extending and retracting a bolt; an exterior and interior key cylinders on opposite sides of said means, comprising:

a first torque blade extending from said exterior key cylinder through said means and including a generally hollow blade in operative engagement therewith; a second torque blade extending from said interior key cylinder towards said means and including a longitudinally extending blade telescopically received within the hollow blade of said first torque blade; said interior key cylinder comprising a cylinder housing and a cylinder plug rotatably mounted therewithin;

a retaining ring mounted on said plug for rotation therewith for maintaining said plug axially positioned within said housing, said ring including a drive lug extending radially inward toward the horizontal axis of said interior key cylinder;

said interior torque blade including an enlarged head portion positioned within said plug and including a radially extending slot; and means for biasing said interior torque blade in an axially spaced position with respect to said retaining ring, said interior torque blade being movable towards said retaining ring in response to a key inserted in said interior cylinder to place said drive lug into driving engagement with said radially extending slot of the enlarged head portion of said interior torque blade.

11. A double cylinder lock assembly in accordance with claim 10 wherein said biasing means comprises a first spring retained between an interior end of said interior cylinder and an exterior end of said enlarged head portion of said interior torque blade.

12. A double cylinder lock assembly in accordance with claim 11 wherein said spring is compressed by said key in said interior cylinder.

13. A double cylinder lock assembly in accordance with claim 12 further including a second spring positioned within said hollow blade and having one end in engagement with the end of said interior torque blade remote from said enlarged head portion for providing a force for disengaging the drive lug from the radially extending slot upon removal of said key from the interior cylinder.

* * * * *